United States Patent [19]

Reinhardt

[11] Patent Number: 4,976,211

[45] Date of Patent: Dec. 11, 1990

[54] BOAT LAUNCHING SYSTEM

[76] Inventor: Lloyd C. Reinhardt, 35398 Hunt Club Rd., Gurnee, Ill. 60031

[21] Appl. No.: 283,202

[22] Filed: Dec. 12, 1988

Related U.S. Application Data

[63] Continuation of Ser. No. 91,089, Aug. 31, 1987, abandoned.

[51] Int. Cl.[5] ..... B63C 1/06

[52] U.S. Cl. ..... 114/44; 405/3

[58] Field of Search ..... 114/44, 50, 51, 344, 114/365, 366; 405/1, 2, 3; 414/246, 260, 592, 630, 609–611, 662, 137.1, 137.7; 254/45, 89 R, 89 N, 90; 280/414.1–414.3

[56] References Cited

U.S. PATENT DOCUMENTS

| | | | |
|---|---|---|---|
| 2,761,571 | 9/1956 | Adams | 414/137.7 |
| 2,963,870 | 12/1960 | Machol | 405/3 |
| 3,101,144 | 8/1963 | Hurst | 405/1 |
| 3,252,589 | 5/1966 | Keene | 405/3 |
| 3,287,921 | 11/1966 | Wilson | 405/3 |
| 3,332,248 | 7/1967 | Burnett | 114/44 |
| 3,409,153 | 11/1968 | Stearn | 405/3 |
| 3,463,271 | 8/1969 | St. Louis | 405/3 |
| 3,687,309 | 8/1972 | Macrander | 414/137.7 |
| 4,381,723 | 5/1983 | Furst | 405/3 |
| 4,599,027 | 7/1986 | Knapp | 414/137.7 |
| 4,739,721 | 4/1988 | Peyre | 414/137.7 |
| 4,750,444 | 6/1988 | Lenvig | 405/3 |

FOREIGN PATENT DOCUMENTS

| | | | |
|---|---|---|---|
| 738941 | 8/1980 | U.S.S.R. | 405/3 |
| 802314 | 10/1958 | United Kingdom | 405/3 |

*Primary Examiner*—Joseph F. Peters, Jr.
*Assistant Examiner*—Clifford T. Bartz
*Attorney, Agent, or Firm*—Alan R. Thiele

[57] ABSTRACT

A system for launching a boat includes a platform which is movable horizontally over the edge of a seawall, a dock or the like. Once the platform has been moved over the edge of the seawall, it then may be lowered vertically under the surface of the water. Once under the surface of the water, the boat may be floated away from its support on the platform.

7 Claims, 6 Drawing Sheets

BOAT LAUNCHING SYSTEM

This application is a continuation of application Ser. No. 091,089, filed Aug. 31, 1987, now abandoned.

BACKGROUND OF THE INVENTION

The present invention applies to boat launching systems; more particularly, the present invention applies to systems for launching boats from boat trailers.

Pleasure boating has become a great pastime for many people. Such pleasure boating normally occurs on weekends, during holiday periods or vacations. Owners of pleasure boats typically load their boats onto trailers or cradles and tow them with an automobile or truck to a body of water. The boats are typically launched into the body of water by allowing the trailer and boat combination to roll backward down a boat launching ramp until the rear portion of the boat and trailer are in the water. The boat is then allowed to slide off the trailer until it floats freely.

Oftentimes, boat launching ramps have a dirt surface. Such dirt surfaces become quickly worn and slippery as more and more boats are launched. Others are covered by macadam or concrete but the combined action of the sloping surface and the water necessitates frequent repair and maintenance on the launching ramp. Additionally, it is required that the water be at a certain level to make the boat launching ramp usable.

The general inexperience of boat owners also contributes to the rapid deterioration of boat launching ramps; specifically, the inartful handling of the tow vehicle and boat trailer eventually tears up the surface of the boat launching ramp and renders it unusable.

Boat launching ramps may also be harmful to boats, trailers and tow vehicles. The sliding of the boat from its mounts on the trailer oftentimes damages the underside of the boat or the boat trailer itself. As boat trailers usually remain hitched to tow vehicles while boats are being launched, stress on the boat trailer is transferred to the tow vehicle. Such transferred stress may cause accelerated wear of the tow vehicle's brake system or drive train.

Other more sophisticated boat launching systems have been tried. One such system uses flexible straps placed underneath the boat. While resting in the straps, the boat is placed in the water. Once the support straps are released, the boat floats freely. Another boat launching system uses a forklift truck having extended tines. The boat hull is cradled between the extended tines and the boat is then set into the water. Both the support strap system and the fork lift system are expensive. Accordingly, they are usually found in large marinas that service many boats. Because of the complexity of these two systems, trained operators must be used. Additionally, the support strap and the fork lift systems require actual contact with and manipulation of the underside of the boat hull. Such repeated contact may lead to hull damage and expensive repairs.

Still other trailer based boat launching systems have been taught. These systems frequently require attachment of the support structure to the bottom of the lake, river etc. Such attachment is inconvenient in deep water or in situations where the bottom is unstable.

There is therefor a need in the art to provide a simplified boat launching system which requires a minimal amount of maintenance, a minimum of boat manipulation, reduced contact with the boat hull and does not require connection with the bottom of a body of water. Such system should be easily usable by weekend, holiday or vacation boaters. Additionally, such boat launching system should provide for the quick launching of boats. Finally such system should be inexpensive and easy to repair so that it may be used in bodies of water without large marinas supporting a big fleet of watercraft.

SUMMARY OF THE INVENTION

An inexpensive, easy-to-use, system for launching boats which eliminates boat hull contact and does not require connection to the bottom of a body of water includes a platform of sufficient width and length to support a wide range of commonly available pleasure boat trailers. The tow vehicle, with boat and trailer attached, is driven across the platform member and then positioned so that the trailer and boat combination remains on the platform. Once unhooked from the tow vehicle the boat and trailer combination may be secured to the platform member. The platform member is then moved horizontally toward the body of water on a rail or track system. Such movement places the platform member over the edge of a seawall, a dock or the like. Once over the body of water, the platform member is then lowered vertically into the body of water so that the the boat trailer is submerged. The boat may then float, by its own buoyancy, away from the boat trailer. Once afloat, the boat is maneuvered away from the boat trailer so that it may be used for pleasure boating, fishing or transport. The platform, which still supports the boat trailer, is raised vertically back to the level of the top of the seawall or the dock and moved horizontally onto the top of the seawall, the dock, or the like. The boat trailer may then be driven away from the platform by the tow vehicle.

To remove a boat from water after use, the foregoing process is repeated in reverse order. Specifically, an empty trailer is placed on the platform. The platform is then moved horizontally out over the body of water and lowered vertically so that the platform member and boat trailer are submerged. The boat is then maneuvered over the submerged trailer and the platform containing the trailer is then moved vertically upward under the boat to support its weight. The platform trailer and boat are then raised vertically to the top of the seawall, the dock or the like where they are retracted horizontally back onto the top of of the seawall, dock or the like. The trailer and boat combination is then driven from the platform by the tow vehicle.

BRIEF DESCRIPTION OF THE DRAWINGS

A better understanding of the boat launching system of the present invention may be had by reference to the drawings wherein.

DESCRIPTION OF THE EMBODIMENTS

Figure 1:
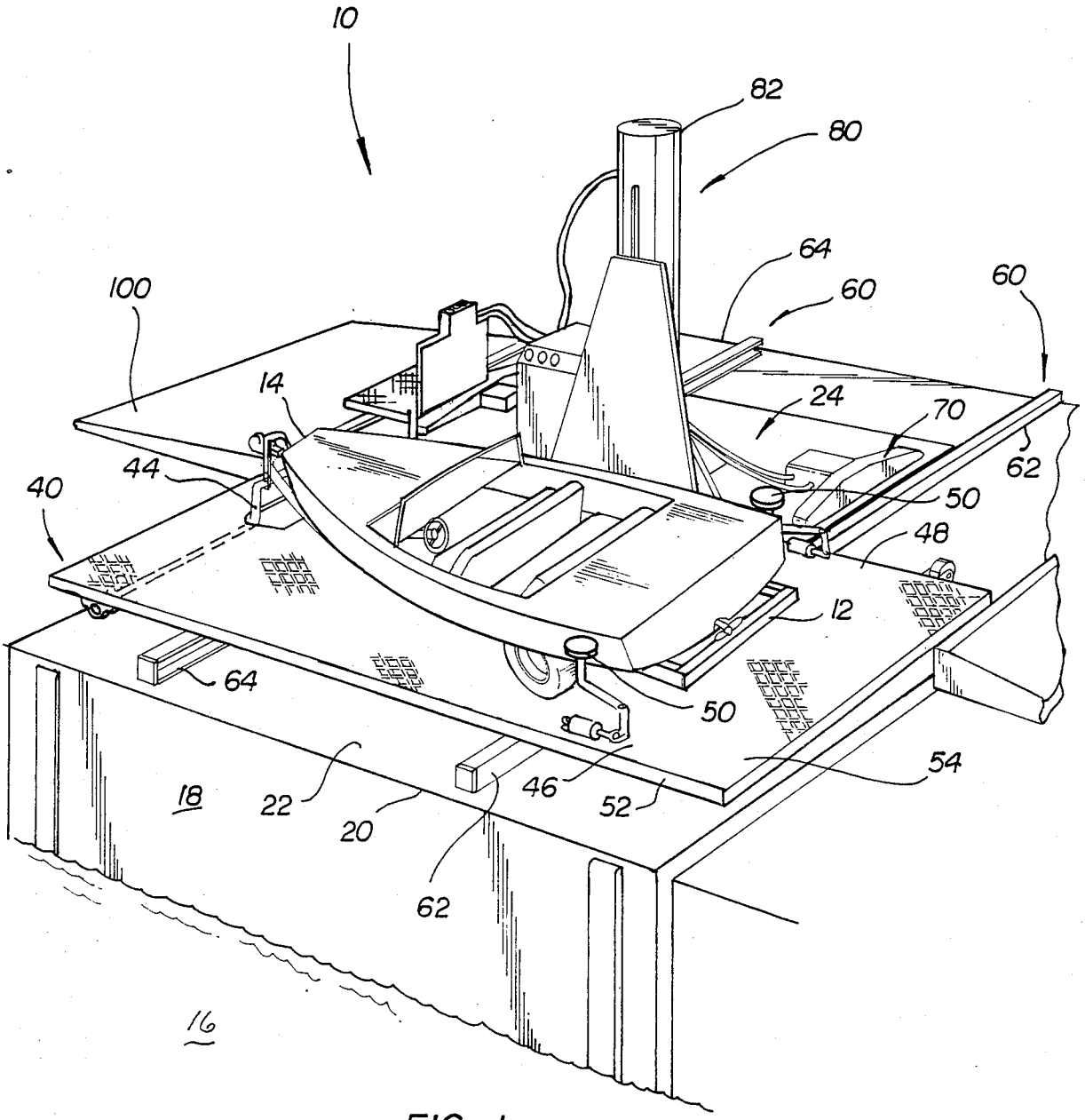
FIG. 1 is a perspective view of the boat launching system of the present invention.
Figure 2:
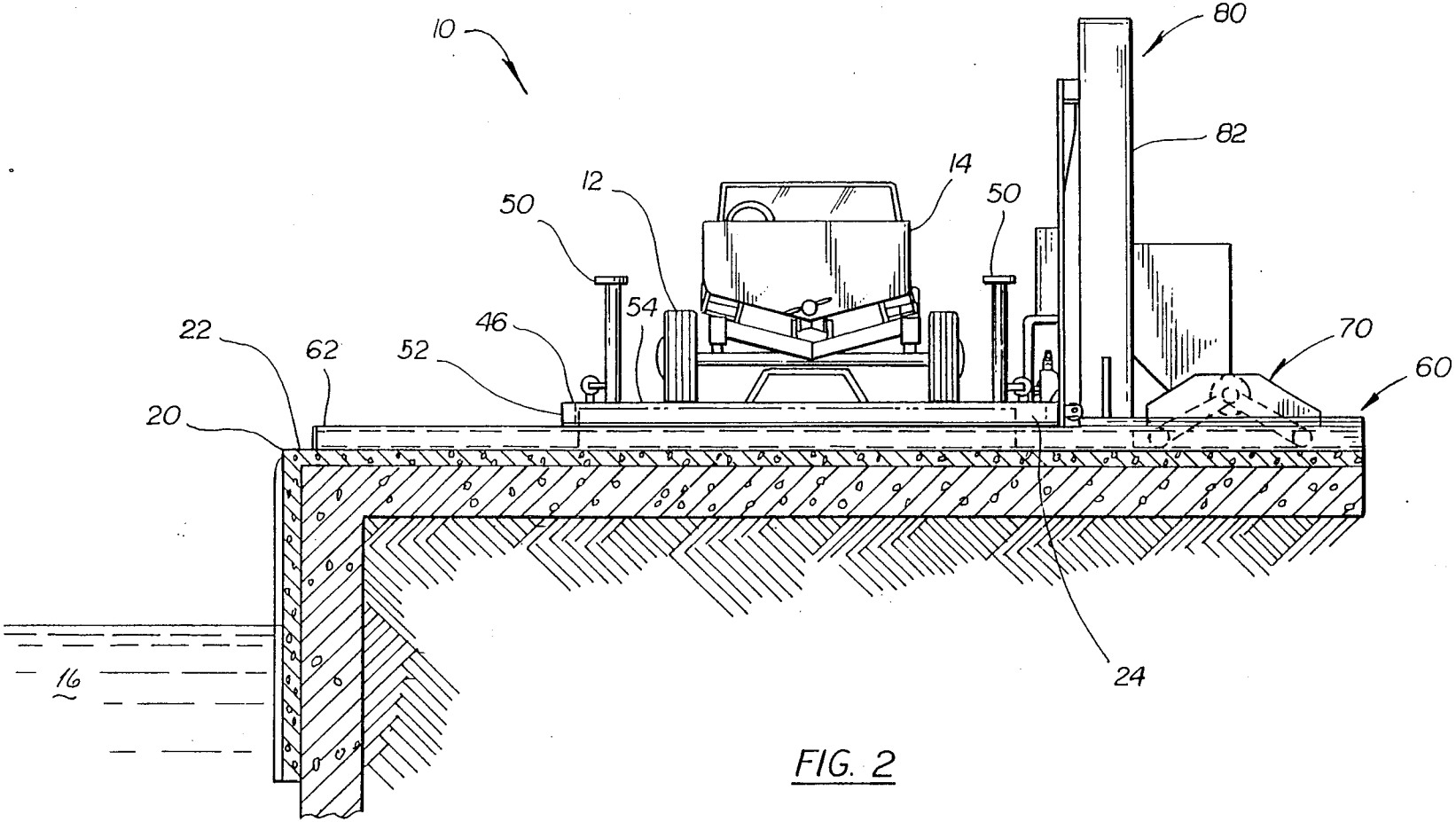
FIG. 2 is a right side elevational view.
Figure 3:
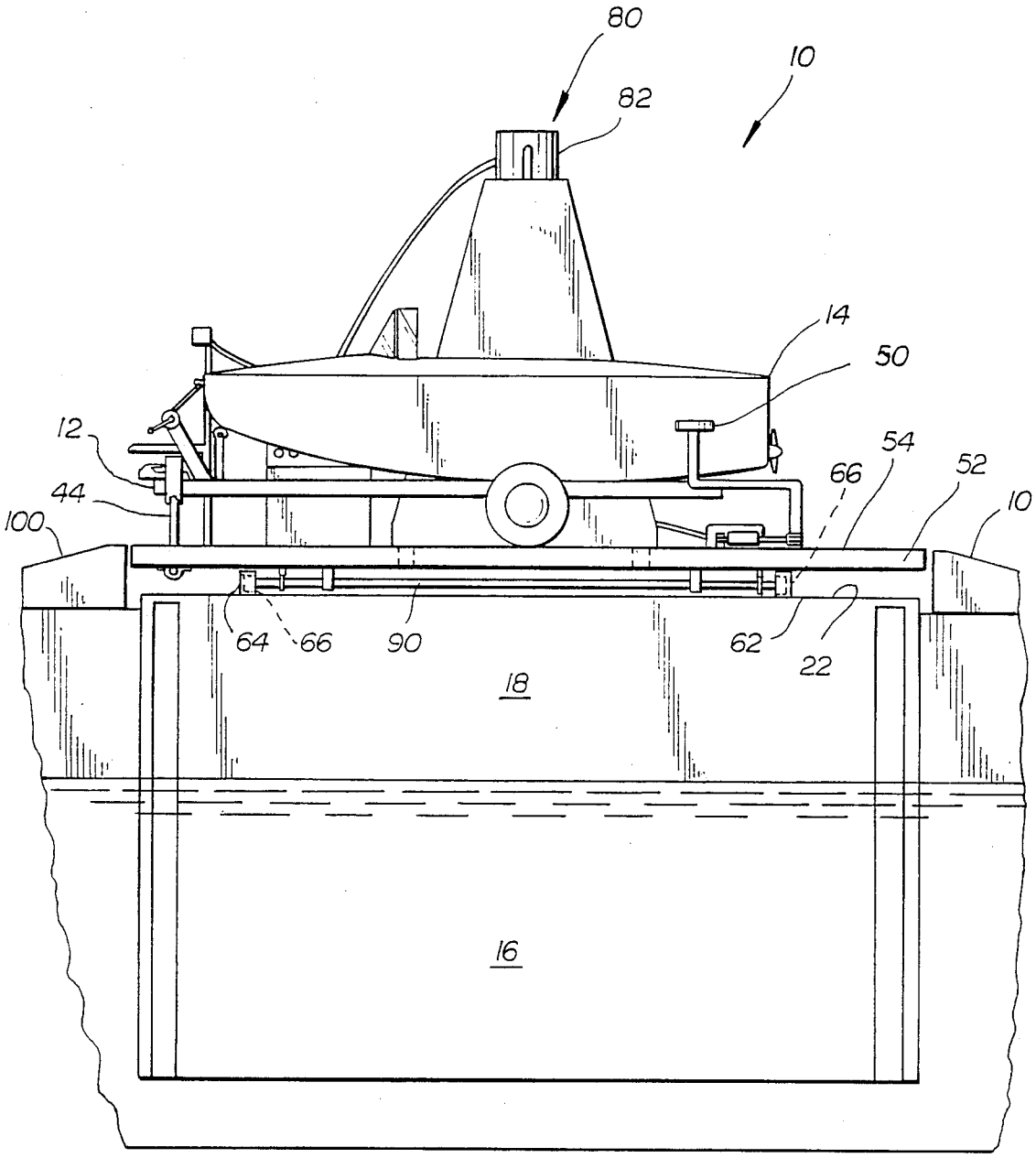
FIG. 3 is a front elevational view.
Figure 4:
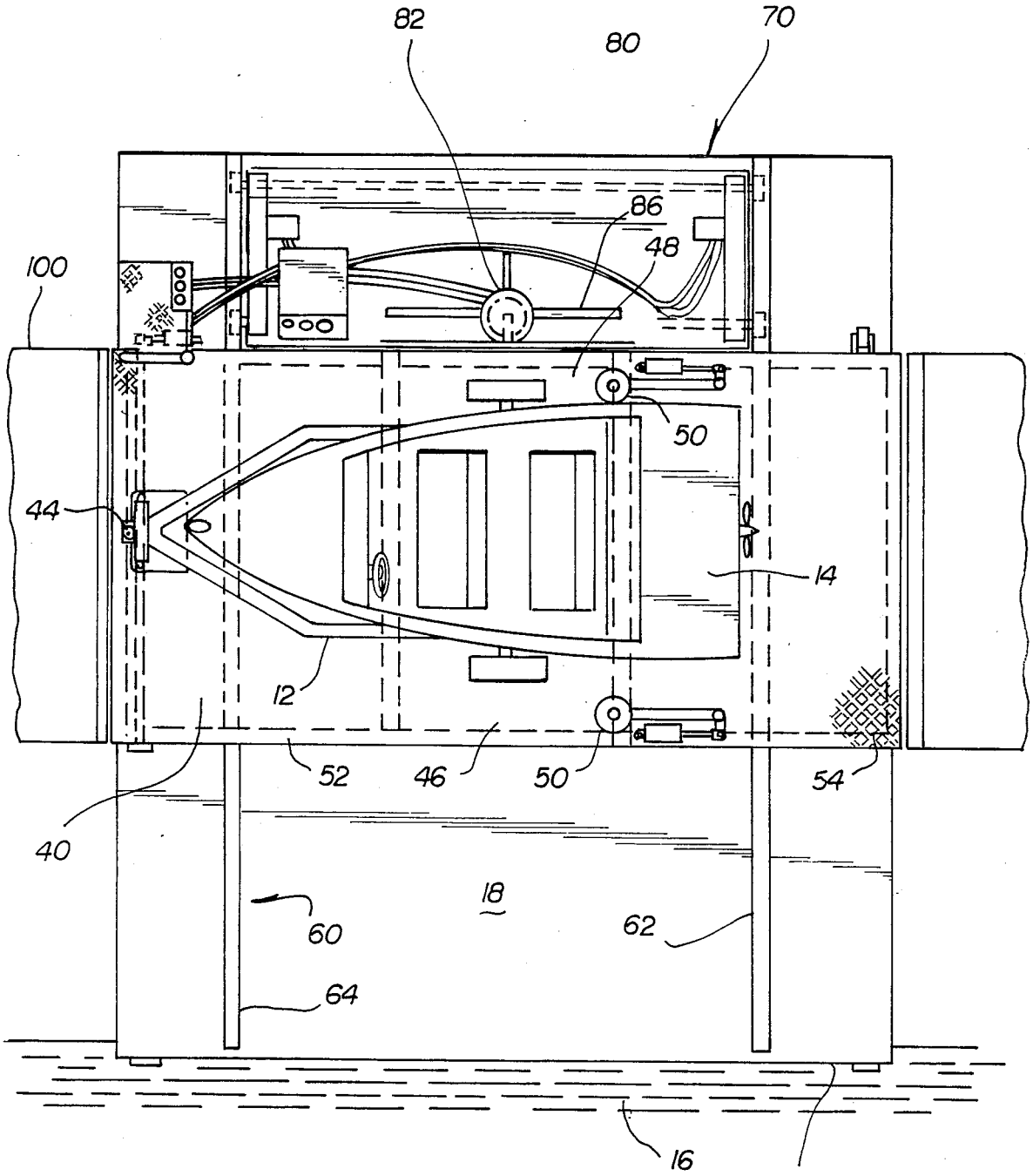
FIG. 4 is a top plan view.

The boat launching system 10 of the present invention may be best understood by reference to FIGS. 1, 2, 3 and 4. Therein it may be seen that boat launching system 10 consists of three essential components. These three components are a platform 40, a rail system 60 and a lift system 80. The function, construction and interrelationship of these three essential components is described in the following paragraphs.

Platform 40 is constructed so as to be suitable for holding commonly available boat trailers or boat support systems 12. Platform 40 may include a securement device 44 for positioning boat trailer 12 on platform 40 once boat trailer 12 has been loaded onto platform 40. The size of boat trailer 12 is such that a tow vehicle (not shown) with a boat 14 and boat trailer 12 in tow may be easily driven over platform 40. If desired, ramps 100 may be used at either end of platform 40. When boat 14 and boat trailer 12 are located on platform 40 trailer 12 may be unhooked from the tow vehicle and positioned by securement device 44 on platform 40 and the tow vehicle driven away.

On sides 46 and 48 of platform 40 guides 50 may be located to assist the driver of the tow vehicle in centering boat trailer 12 on platform 40. Platform 40 may have a steel frame 52 to support surface 54. Surface 54 may be fabricated from expanded metal so that when platform 40 is lowered into water 16, water 16 easily flows through platform 40. While an expanded metal surface 54 is not necessary, it is possible to use metal plates with holes formed therein so that water may pass therethrough.

Figure 8:
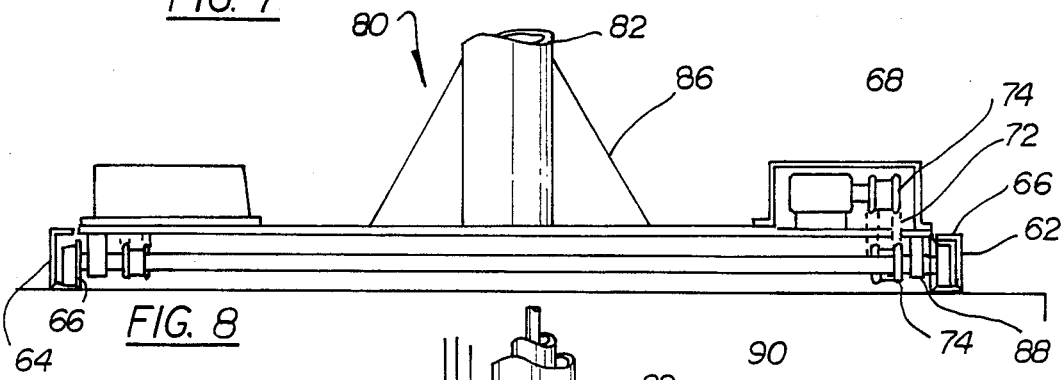
FIG. 8 is a front elevational view of the drive portion of the boat launching system.
Figure 9:
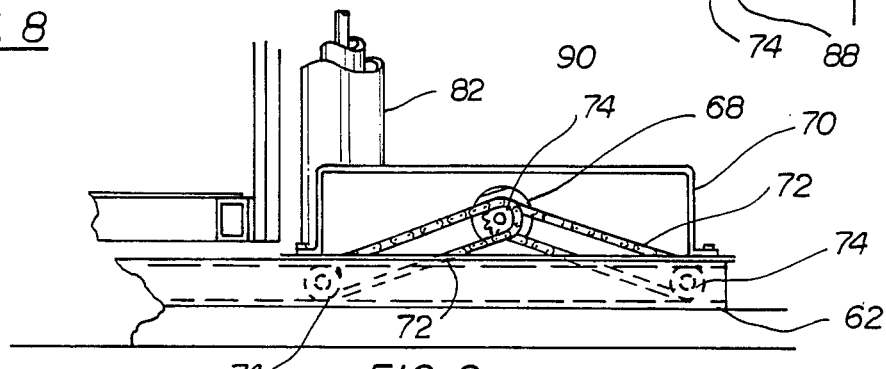
FIG. 9 is a right side elevational view of the drive system.
Figure 10:
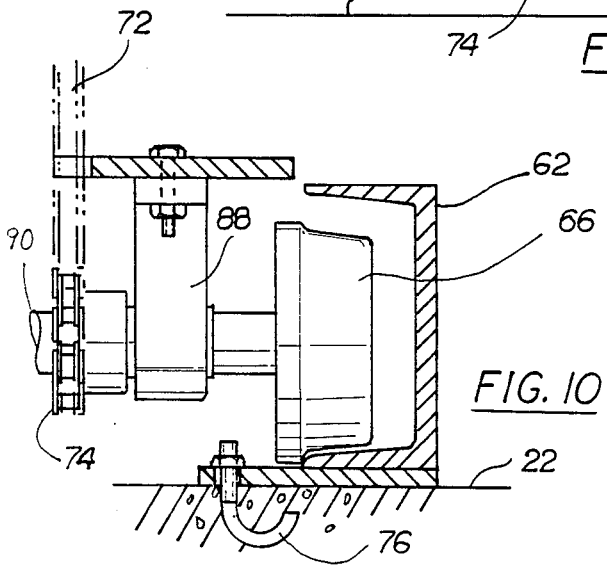
FIG. 10 is a view in partial section of the wheel and rail system.

Horizontal rail movement system 60 is located underneath platform member 40. Movement or rail system 60 extends from that portion of the dock or seawall used for the ingress and egress of vehicles to the edge 20 of dock or seawall 18. As may be seen in FIG. 10, rails 62 and 64 are located on top 22 of dock or seawall 18. Located within rails 62 and 64 are wheels 66 which roll within rails 62 and 64 to move platform 40 across top 22 of dock or seawall 18. Pillow blocks 88 (FIG. 10) provide a mounting for axle 90 which connects wheels 66 on either side of platform 40. The necessity for moving platform 40 across top 22 of seawall 18 will be better understood when the vertical movement of lift system 80 is described. If desired, horizontal movement system 60 may be activated by either a hydraulic or electric motor 68. The drive system 70 for rail movement system 60 including an exemplary chain 72 and sprocket 74 is shown in FIGS. 8, 9 and 10. While a chain and sprocket drive system is shown in the preferred embodiment, it will be understood that a wide range of other suitable systems are usable without departing from the scope of the present invention.

Figure 6:
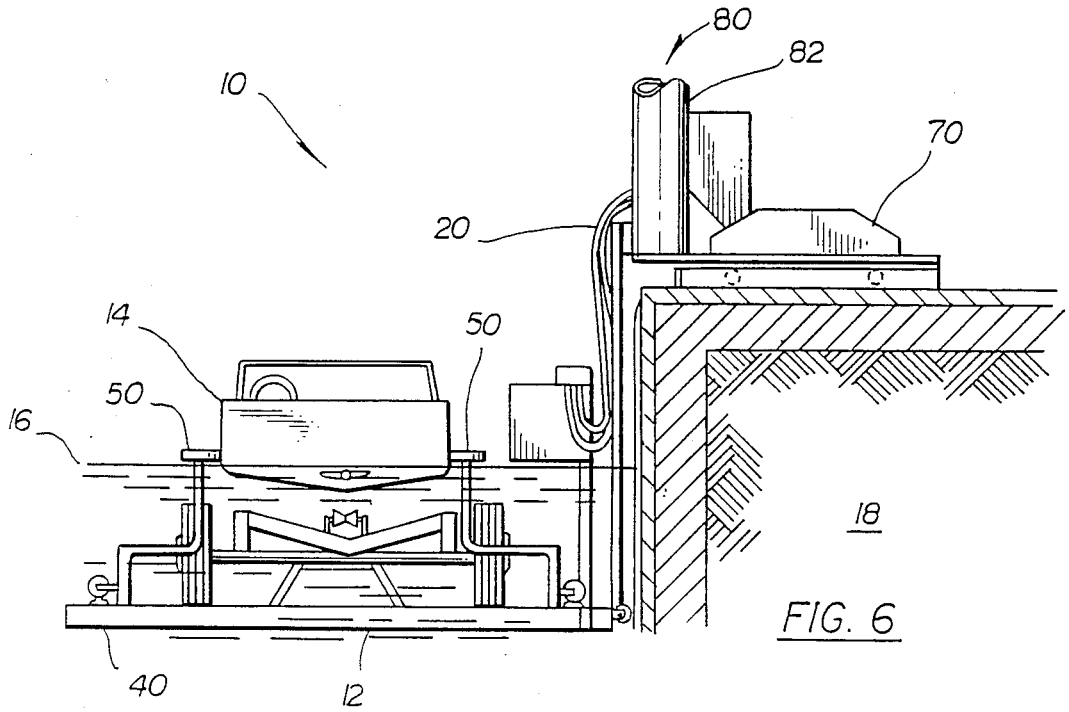
FIG. 6 is a right side elevational view of the replacement of a boat onto a boat trailer.

As platform member 40 is moved out over the surface of water 16, a turning moment is exerted on the rear portion 24 of boat launching system 10. Overcoming of this turning moment requires the use of four wheels 66 as shown in FIGS. 6 and 9. When boat 14 is out over the surface of water 16, wheels 66 engage top portion of rails or channels 62 and 64. Holding rails or channels 62 and 64 to surface 22 of seawall or dock 18 is a J-clamp 76 or other suitable mounting means. If desired, rails or channels 62 and 64 may be embedded in surface 22 of seawall or dock 18 and need not be mounted on top of surface 22.

Figure 7:
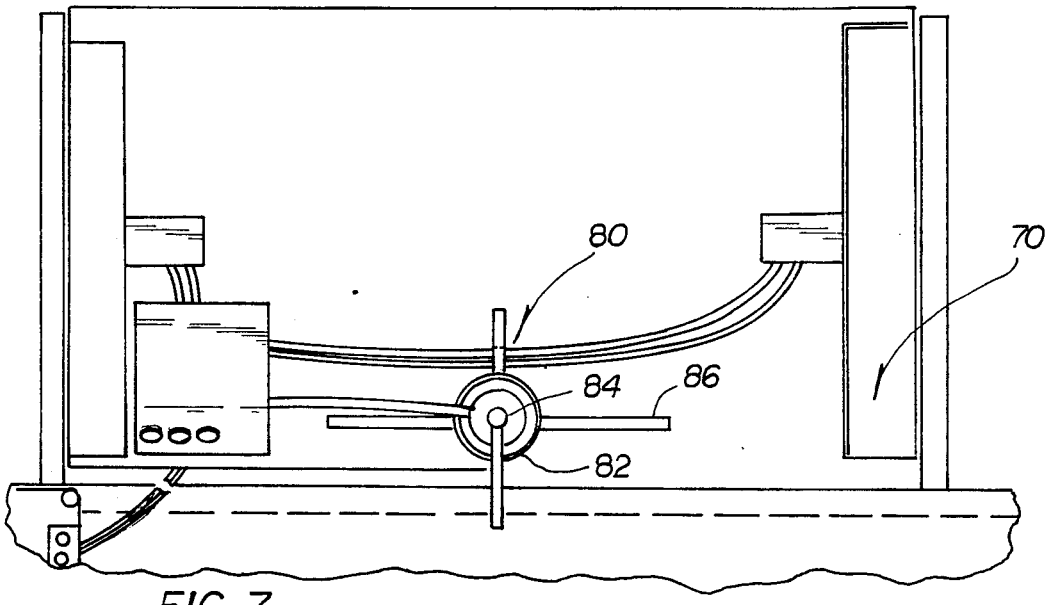
FIG. 7 is a top plan view of the rear support portion of the boat launching system.

The third major component of the boat launching system of the present invention is the vertical movement or lift system 80. The vertical movement system 80 is best shown in FIGS. 7 and 8 and consists of a vertical tube 82 which contains a hydraulic cylinder 84. When platform member 40 is located over the surface of water 16, hydraulic cylinder 84 is used to lower platform 40 and trailer 12 to submerged position just under the surface of water 16. This causes boat 14 to float off trailer 12. Boat 14 may then be maneuvered into the body of water 16 for fishing, pleasure or transport. Buttress supports 86 may be used if desired to provide added rigidity to tube 82.

DESCRIPTION OF OPERATION

Boat launching system 10 of the present invention is best used where a number of pleasure boats are launched at frequent intervals. System 10 is designed so that tow vehicles such as automobiles or trucks pulling boat trailers 12 may be driven across platform 40. After the tow vehicle is driven across platform 40, trailer 12 and boat 14 combination is located on platform 40. If desired, trailer 12 may be secured to platform 40 after it has been unhooked from the tow vehicle. Once boat 14 and trailer 12 combination are located on platform 40, drive system 70 which is connected to wheels 66 is actuated. This causes platform 40 to move out past edge 20 of seawall or dock 18 over body of water 16. Once platform 40 is fully over body of water 16, vertical lift system 80 is engaged. The actuation of vertical lift system 80 causes platform 40 to move down over edge or side 20 of the seawall or dock 18 until platform 40 and trailer 12 goes under the surface of water 16. Boat 14 then floats by its own buoyancy off the trailer or boat support 12. Once boat 14 is floating, it may then be maneuvered into body of water 16.

Figure 5:
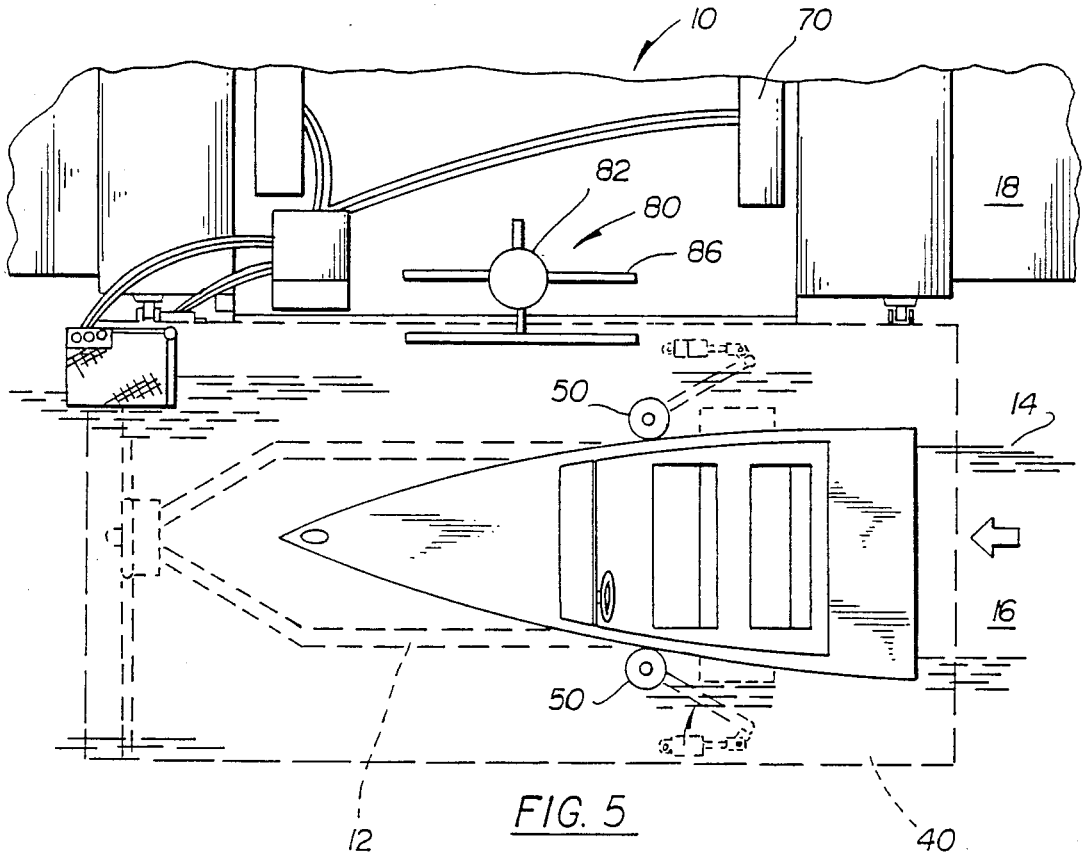
FIG. 5 is a top plan view showing the replacement of a boat onto a boat trailer.

The removal of boat 14 from body of water 16 is shown in FIGS. 5 and 6. This is accomplished by reversal of the foregoing operation. Platform 40 holding empty trailer 12 is moved over edge 20 of the seawall or the like 18 and lowered so that it goes under surface of water 16. Guides 50 remain above the surface of water 16 to provide a visual indication of the location of platform 40. Platform 40 containing trailer 12 is positioned so that boat 14 which is out in body of water 16 may be maneuvered into a position over trailer 12. If desired, guides 50 may be spring biased inward toward the center of trailer 12 to assist in the positioning of boat 14 on trailer 12. Hydraulic cylinder 84 within tube 82 is then activated and platform 40 and trailer 12 begin to rise under boat 14. As they rise, trailer 12 meets the bottom of boat 14 and removes boat 12 from water 16. When platform 40 and trailer 12 reach the top of their travel, they are then moved back over top 22 of seawall, dock or the like 18. The tow vehicle is then hooked to trailer 12 and boat 14 and trailer 12 combination is pulled away.

There has now been provided by the boat launching system of the present invention a simple, inexpensive, easy-to-use system which minimizes boat hull contact. By employment of the present system the problem of continuing care, maintenance and repair of boat ramps may be eliminated. Additionally, the risk of damage to boat hulls is drastically reduced.

A trained operator is not required for the disclosed boat launching system. If desired a coin operated mechanism, such as those used on washing machines in laundromats, could be used to collect a nominal charge for use of the system.

It will be noted that nothing in the present system requires a connection of any sort to the bottom of the body of water. The system may be used in shallow bodies of water or in deep bodies of water. It may also be used where the level of the water fluctuates as with incoming and outgoing tides.

The scope of the invention having now been disclosed, further embodiments of the invention may become apparent to those of ordinary skill in the art.

I claim:

1. A system for launching a boat from a substantially horizontal surface which is elevated above a body of water, said system comprising:

a boat cradle trailer;

a platform member constructed and arranged to support said boat cradle trailer;

means for securing said boat cradle trailer to said platform member;

means for moving said platform member along the substantially horizontal surface in a direction substantially perpendicular to the edge of the substantially horizontal surface to a position over the body of water;

a vertically mounted linear movement device for moving said platform ember substantially vertically from the level of the substantially horizontal surface to a level sufficiently beneath the surface of the body of water to enable the boat to float away from said boat cradle trailer;

said means for moving said platform member substantially vertically from the level of the substantially horizontal surface being located above the surface of the body of water.

2. The system as defined in claim 1 wherein said vertically mounted linear movement device is a hydraulic cylinder.

3. The system as defined in claim 1 wherein said means for moving said platform member along the substantially horizontal surface is a rail and wheel system.

4. The system as defined in claim 3 further including a motor drive for said rail and wheel system.

5. The system as defined in claim 1 further including means for visually indicating the position of said platform member when said platform member is under water, said means for visually indicating position extending upwardly from the edges of said platform member.

6. A method of launching a boat into a body of water from a substantially horizontal surface which is elevated above a body of water comprising the steps of:

placing the boat on a boat cradle trailer;

moving said boat cradle trailer onto a platform;

securing said boat cradle trailer to said platform;

moving said platform over the substantially horizontal surface in a direction substantially perpendicular to the edge of the substantially horizontal surface to a position over the body of water;

moving said platform member substantially vertically with a vertically mounted linear movement device from the level of said substantially horizontal surface to a level sufficiently beneath the surface of the body of the water to enable the boat to float away from said boat cradle trailer.

7. A method of removing the boat from the body of water and moving it to a substantially horizontal surface which is elevated above the body of water comprising the steps of:

placing a boat cradle trailer onto a platform;

securing said boat cradle trailer to said platform;

moving the platform and boat cradle trailer combination along the substantially horizontal surface to a position over the body of water;

lowering said platform and boat cradle trailer combination into said body of water;

moving the boat over said boat cradle trailer;

raising said platform and boat cradle trailer combination out of the body of water with a vertically mounted linear movement device;

moving said platform and boat cradle trailer combination from a position over the body of water to a position on the substantially horizontal surface;

removing said boat and said boat cradle trailer from said platform;

unsecuring said boat cradle trailer from said platform after said platform has been moved away from a position over said body of water.

* * * * *